US009260215B2

(12) United States Patent
Coltri-Johnson et al.

(10) Patent No.: US 9,260,215 B2
(45) Date of Patent: Feb. 16, 2016

(54) SHIPPING AND DISPENSING CARTON

(71) Applicant: Graphic Packaging International, Inc., Atlanta, GA (US)

(72) Inventors: Andrea Coltri-Johnson, Sao Paulo (BR); Jean-Manuel Gomes, Acworth, GA (US); Edward W. Jones, Hiram, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 72 days.

(21) Appl. No.: 14/095,136

(22) Filed: Dec. 3, 2013

(65) Prior Publication Data

US 2014/0091133 A1 Apr. 3, 2014

Related U.S. Application Data

(60) Division of application No. 11/549,355, filed on Oct. 13, 2006, now Pat. No. 8,622,280, which is a continuation-in-part of application No. 11/524,574, filed on Sep. 21, 2006, now Pat. No. 8,827,144.

(60) Provisional application No. 60/726,408, filed on Oct. 13, 2005, provisional application No. 60/719,309, filed on Sep. 21, 2005.

(51) Int. Cl.
*B65D 5/54* (2006.01)
*B65D 5/44* (2006.01)
(Continued)

(52) U.S. Cl.
CPC . *B65D 5/445* (2013.01); *B31B 1/25* (2013.01); *B31B 1/26* (2013.01); *B31B 1/90* (2013.01); *B31B 7/00* (2013.01); *B65D 5/5253* (2013.01); *B65D 5/542* (2013.01); *B65D 5/5445* (2013.01); *B65D 5/566* (2013.01); *B65D 5/705* (2013.01); *B65D 5/725* (2013.01); *B65D 71/36* (2013.01); *B65D 2571/0066* (2013.01);
(Continued)

(58) Field of Classification Search
CPC ..... B65D 5/5445; B65D 5/542; B65D 5/66; B65D 2571/00864; B65D 2571/574; B65D 2571/00567; B65D 2571/00814
USPC ..... 229/146, 235
See application file for complete search history.

(56) References Cited

U.S. PATENT DOCUMENTS 499,655 A 6/1893 Clark
642,121 A 1/1900 Hildreth
(Continued)

FOREIGN PATENT DOCUMENTS

DE 2 320 190 11/1973
DE 36 27 019 A1 2/1988
(Continued)

OTHER PUBLICATIONS

European Search Report for EP 08 01 0412 dated Oct. 22, 2008.
(Continued)

*Primary Examiner* — Gary Elkins
(74) *Attorney, Agent, or Firm* — Womble Carlyle Sandridge & Rice, LLP

(57) ABSTRACT

A combination shipping and dispensing carton for containing a plurality of articles. The carton has a plurality of panels that extend at least partially around an interior of the carton. The carton may have various dispensing features to allow articles to be dispensed from the carton.

24 Claims, 19 Drawing Sheets

(51) Int. Cl.

| | |
|---|---|
| ***B65D 5/52*** | (2006.01) |
| ***B65D 71/36*** | (2006.01) |
| ***B31B 1/25*** | (2006.01) |
| ***B31B 1/26*** | (2006.01) |
| ***B31B 1/90*** | (2006.01) |
| ***B31B 7/00*** | (2006.01) |
| ***B65D 5/56*** | (2006.01) |
| ***B65D 5/70*** | (2006.01) |
| ***B65D 5/72*** | (2006.01) |

(52) U.S. Cl.

CPC ..... *B65D 2571/00141* (2013.01); *B65D 2571/00444* (2013.01); *B65D 2571/00567* (2013.01); *B65D 2571/00574* (2013.01); *B65D 2571/00728* (2013.01); *B65D 2571/00814* (2013.01); *B65D 2571/00864* (2013.01)

(56) References Cited

U.S. PATENT DOCUMENTS

| | | | | |
|---|---|---|---|---|
| 1,503,161 | A | 7/1924 | Hornecker | |
| 1,634,073 | A | 6/1927 | Labombarde | |
| 1,656,919 | A | 1/1928 | Marsh | |
| 1,762,704 | A | 6/1930 | Smith | |
| 1,901,483 | A | 3/1933 | Ware, Jr. | |
| 1,912,698 | A | 6/1933 | Forsman | |
| 1,925,102 | A | 9/1933 | Levkoff | |
| 1,951,408 | A | 3/1934 | Haven | |
| 1,971,863 | A | 8/1934 | Lupton | |
| 2,027,079 | A | 1/1936 | Weiss | |
| 2,141,743 | A | 12/1938 | Ethridge | |
| 2,145,430 | A | 1/1939 | New | |
| 2,152,079 | A | 3/1939 | Mott | |
| 2,196,243 | A | 4/1940 | Bensel | |
| 2,290,971 | A | 7/1942 | King | |
| 2,330,294 | A | 9/1943 | Leavitt et al. | |
| 2,383,853 | A | 8/1945 | Guyer | |
| 2,407,802 | A | 9/1946 | Stotter | |
| 2,416,332 | A | 2/1947 | Lehman | |
| 2,643,589 | A | 6/1953 | Weiss | |
| 2,679,349 | A | 5/1954 | Mullinix | |
| 2,710,134 | A | 6/1955 | Schroeder et al. | |
| 2,791,362 | A | 5/1957 | Nute | |
| 2,852,177 | A * | 9/1958 | Elizabeth | 229/120.32 |
| 2,875,938 | A | 3/1959 | Bramhill | |
| 2,887,389 | A * | 5/1959 | Linville | 426/124 |
| 2,909,312 | A * | 10/1959 | Conerty | 229/235 |
| 2,933,228 | A | 4/1960 | Reynolds | |
| 2,954,913 | A | 10/1960 | Rossman | |
| 2,967,610 | A | 1/1961 | Ebert et al. | |
| 3,002,613 | A | 10/1961 | Merkel et al. | |
| 3,090,483 | A | 5/1963 | Altree et al. | |
| 3,092,301 | A | 6/1963 | Selle | |
| 3,094,266 | A | 6/1963 | Hoff | |
| 3,157,342 | A | 11/1964 | Grady | |
| 3,158,312 | A | 11/1964 | Daniel | |
| 3,164,316 | A * | 1/1965 | Wurster et al. | 229/228 |
| 3,199,763 | A | 8/1965 | Anderson | |
| 3,265,283 | A | 8/1966 | Farquhar | |
| 3,276,665 | A | 10/1966 | Rasmussen | |
| 3,280,968 | A | 10/1966 | Craine | |
| 3,434,648 | A | 3/1969 | Du Barry, Jr. | |
| 3,653,495 | A | 4/1972 | Gray | |
| 3,677,458 | A | 7/1972 | Gosling | |
| 3,698,548 | A * | 10/1972 | Stenzel et al. | 242/588.4 |
| 3,759,378 | A | 9/1973 | Werth | |
| 3,786,914 | A | 1/1974 | Beutler | |
| 3,884,348 | A | 5/1975 | Ross | |
| 4,008,849 | A | 2/1977 | Baber | |
| 4,059,220 | A | 11/1977 | Lorenz | |
| 4,113,100 | A | 9/1978 | Soja et al. | |
| 4,267,959 | A * | 5/1981 | Gilbert | 229/117.14 |
| 4,519,538 | A | 5/1985 | Omichi | |
| 4,558,785 | A | 12/1985 | Gordon | |
| 4,586,643 | A | 5/1986 | Halabisky et al. | |
| 4,742,917 | A | 5/1988 | Bornwasser | |
| 4,760,952 | A | 8/1988 | Wachter et al. | |
| 4,773,541 | A | 9/1988 | Riddell | |
| 4,778,057 | A | 10/1988 | Allen et al. | |
| 4,815,609 | A | 3/1989 | Kiedaisch | |
| 4,865,187 | A | 9/1989 | Zulauf et al. | |
| 4,886,160 | A | 12/1989 | Kligerman | |
| 4,919,269 | A | 4/1990 | Wright et al. | |
| 5,012,929 | A | 5/1991 | Roosa | |
| 5,181,650 | A | 1/1993 | Hollander et al. | |
| 5,222,660 | A | 6/1993 | Koss | |
| 5,328,091 | A | 7/1994 | Koss | |
| 5,505,372 | A * | 4/1996 | Edson et al. | 229/121 |
| 5,699,957 | A | 12/1997 | Blin et al. | |
| 5,783,030 | A | 7/1998 | Walsh | |
| 5,842,576 | A | 12/1998 | Snow | |
| 5,857,570 | A | 1/1999 | Brown | |
| 5,881,884 | A | 3/1999 | Podosek | |
| D412,114 | S | 7/1999 | Hansen | |
| 5,921,398 | A | 7/1999 | Carroll | |
| 5,927,498 | A | 7/1999 | Saam | |
| 5,979,749 | A | 11/1999 | Bozich | |
| D419,440 | S | 1/2000 | Hansen | |
| 6,015,084 | A | 1/2000 | Mathieu et al. | |
| 6,027,017 | A | 2/2000 | Kuhn et al. | |
| 6,129,211 | A | 10/2000 | Prakken et al. | |
| 6,135,289 | A | 10/2000 | Miller | |
| 6,158,579 | A | 12/2000 | Rosenbaum | |
| 6,386,369 | B2 | 5/2002 | Yuhas et al. | |
| 6,419,152 | B1 | 7/2002 | Tokarski | |
| 6,435,351 | B1 | 8/2002 | Gibb | |
| 6,478,159 | B1 | 11/2002 | Taylor et al. | |
| 6,510,982 | B2 | 1/2003 | White | |
| 6,523,692 | B2 | 2/2003 | Gregory | |
| 6,729,475 | B2 | 5/2004 | Yuhas et al. | |
| 6,854,639 | B2 | 2/2005 | Walsh | |
| 6,869,009 | B2 | 3/2005 | Sutherland et al. | |
| 6,905,027 | B2 | 6/2005 | Galter | |
| 6,913,189 | B2 | 7/2005 | Oliff et al. | |
| 6,918,487 | B2 | 7/2005 | Harrelson | |
| 6,935,557 | B2 * | 8/2005 | Aubry et al. | 229/235 |
| 7,021,468 | B2 | 4/2006 | Cargile, Jr. | |
| 7,201,714 | B2 | 4/2007 | Zoeckler et al. | |
| 8,196,805 | B2 * | 6/2012 | Brand et al. | 229/117.32 |
| 2001/0048022 | A1 | 12/2001 | Zoeckler | |
| 2002/0170845 | A1 | 11/2002 | Oliff | |
| 2003/0226879 | A1 | 12/2003 | Auclair et al. | |
| 2005/0092649 | A1 | 5/2005 | Ford et al. | |
| 2005/0167291 | A1 | 8/2005 | Sutherland | |
| 2005/0218203 | A1 | 10/2005 | Harrelson | |
| 2006/0255106 | A1 * | 11/2006 | Green | 229/101.2 |
| 2006/0266815 | A1 | 11/2006 | Coltri-Johnson et al. | |

FOREIGN PATENT DOCUMENTS

| | | | |
|---|---|---|---|
| DE | 298 17 195 | U1 | 11/1998 |
| DE | 202 16 854 | U1 | 1/2003 |
| EP | 0 133 595 | A2 | 2/1985 |
| EP | 0 704 386 | A1 | 4/1996 |
| FR | 1.379.931 | | 12/1963 |
| FR | 2 882 032 | | 8/2006 |
| GB | 1 218 016 | | 1/1971 |
| WO | WO 98/31593 | | 7/1998 |
| WO | WO 03/082686 | A1 | 10/2003 |
| WO | WO 2004/063031 | A1 | 7/2004 |

OTHER PUBLICATIONS

International Search Report and Written Opinion for PCT/US06/039865 dated Feb. 25, 2008.

Annex to Form PCT/ISA/266 Communication Relating to the Results of the Partial International Search for PCT/US06/039865 dated Mar. 8, 2007.

International Search Report for PCT/US06/036818 dated Feb. 5, 2007.

Preliminary Amendment for U.S. Appl. No. 11/549,355 dated Jun. 3, 2008.

(56) References Cited

OTHER PUBLICATIONS

Office Action for U.S. Appl. No. 11/549,355 dated Oct. 1, 2009.
Response to Election of Species Requirement for U.S. Appl. No. 11/549,355 dated Nov. 2, 2009.
Office Action for U.S. Appl. No. 11/549,355 dated Feb. 18, 2010.
Amendment A and Response to Office Action for U.S. Appl. No. 11/549,355 dated May 18, 2010.
Office Action for U.S. Appl. No. 11/549,355 dated Aug. 11, 2010.
Request for Continued Examination (RCE) Transmittal for U.S. Appl. No. 11/549,355 dated Nov. 10, 2010.
Amendment B and Response to Office Action for U.S. Appl. No. 11/549,355 dated Nov. 10, 2010.
Office Action for U.S. Appl. No. 11/549,355 dated May 14, 2013.
Amendment C and Response to Office Action for U.S. Appl. No. 11/549,355 dated Jul. 30, 2013.
Notice of Allowance and Fee(s) Due for U.S. Appl. No. 11/549,355 dated Sep. 3, 2013.
Part B — Fee(s) Transmittal for U.S. Appl. No. 11/549,355 dated Dec. 3, 2013.
Issue Notification for U.S. Appl. No. 11/549,355 dated Dec. 18, 2013.

* cited by examiner

SHIPPING AND DISPENSING CARTON

CROSS-REFERENCE TO RELATED APPLICATIONS

This application is a divisional of U.S. application Ser. No. 11/549,355, filed Oct. 13, 2006, which claims the benefit of U.S. Provisional Application No. 60/726,408, filed Oct. 13, 2005, and U.S. application Ser. No. 11/549,355 is a continuation-in-part of application Ser. No. 11/524,574, filed Sep. 21, 2006, which claims the benefit of U.S. Application No. 60/719,309, filed Sep. 21, 2005.

INCORPORATION BY REFERENCE

U.S. application Ser. No. 11/549,355, which was filed on Oct. 13, 2006, U.S. Provisional Application No. 60/726,408, which was filed on Oct. 13, 2005, U.S. application Ser. No. 11/524,574, which was filed on Sep. 21, 2006, and U.S. Provisional Application No. 60/719,309, which was filed on Sep. 21, 2005, are hereby incorporated by reference for all purposes as if presented herein in their entirety.

BACKGROUND OF THE INVENTION

The present invention generally relates to cartons for holding and dispensing containers or other types of articles.

Cartons are typically shipped in bulk quantities. During shipping, the cartons may be vertically stacked upon each other in order to maximize the amount of product shipped in a particular vessel. The amount of product shipped may depend, however, on the load-bearing capacity of the stacked cartons. It is therefore sometimes desirable to produce cartons having high rigidity and/or strength in compression for shipping, and for other purposes such as the protection of the carton contents in general.

A conventional method for increasing the strength of a carton is to produce the carton from a blank of a different, stronger board material, or to produce the blank from the same carton material but of greater thickness. Such methods typically increase the costs associated with manufacturing the carton, with the material costs of manufacture generally increasing according to the cost of increasing the strength and/or thickness of the entire blank. Some sections of the blank, however, may not be load-bearing, and the additional costs associated with increasing the strength of non load-bearing bearing sections of the blank are wasted.

Furthermore, a need often exists for a satisfactory carton suitable for containing the product or containers during shipping and for displaying and dispensing the product or containers.

SUMMARY OF THE INVENTION

In one embodiment, the present invention is generally directed to a carton formed from a primary blank and at least a first reinforcing blank. The carton comprises a first side panel, a bottom panel, a second side panel, and a top panel. At least one first end flap at least partially closes a first end of the carton. At least one second end flap at least partially closes a second end of the carton. The first reinforcing blank is adhered to the primary blank at the first end of the carton, at which end the carton is multi-ply. A dispensing feature is located in the primary blank.

In another embodiment, the invention is generally directed to a carton blank comprising a primary blank. The primary blank comprises a plurality of foldably connected primary panels and a plurality of first primary end flaps. Each first primary end flap is foldably connected to at least one of the primary panels. The primary blank comprises a plurality of second primary end flaps. Each second primary end flap is foldably connected to at least one of the primary panels. A first reinforcing blank is attached to the primary blank. The first reinforcing blank comprises a plurality of foldably connected first reinforcing panels. A dispensing feature is located in the primary blank.

In another embodiment, the invention is generally directed to a combination shipping and dispensing carton for containing a plurality of articles. The carton comprises a plurality of panels that extend at least partially around an interior of the carton, wherein the interior is for containing the plurality of articles. At least one line of separation at least partially divides the carton into a first portion and a second portion. The first and second portions are configured for being at least partially separated from one another along the line of separation to convert the carton from a shipping carton to at least one dispensing carton in which the first portion is a first dispensing portion for containing a first subset of the articles, and the second portion is a second dispensing portion for containing a second subset of the articles.

In another embodiment, the invention is generally directed to a blank for forming a combination shipping and dispensing carton. The blank comprises a plurality of panels and at least one line of separation that at least partially divides the blank into a first portion and a second portion. The first and second portions are configured for being at least partially separated from one another along the line of separation in a carton erected from the blank to convert the carton from a shipping carton to at least one dispensing carton. In the dispensing carton, the first portion is a first dispensing portion for containing a first subset of the articles, and the second portion is a second dispensing portion for containing a second subset of the articles.

In another embodiment, the invention is generally directed to a method of enclosing and displaying a plurality of articles. The method comprises providing a blank. The blank comprises a plurality of panels and at least one line of separation that at least partially divides the blank into a first portion and a second portion. The method further comprises erecting the blank into a carton. The erecting of the blank into the carton comprises erecting the first portion of the blank into a first portion of the carton, and erecting the second portion of the blank into a second portion of the carton. The method further comprises enclosing a plurality of articles in the carton and providing access to at least some of the plurality of articles. The providing of the access comprises at least partially separating the first and second portions of the carton from one another along the line of separation to respectively form a first dispensing portion containing a first subset of the articles, and a second dispensing portion containing a second subset of the articles.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present invention generally relates to cartons that contain articles such as pouches, containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present invention can accommodate articles, or subsets of articles, of any shape. For the purpose of illustration and not for the purpose of limiting the scope of the invention, the following detailed description describes beverage containers (e.g., beverage pouches) as disposed within the carton embodiments. In this specification, the terms "lower," "bottom," "upper" and "top" indicate orientations determined in relation to fully erected and upright cartons.

Figure 1:
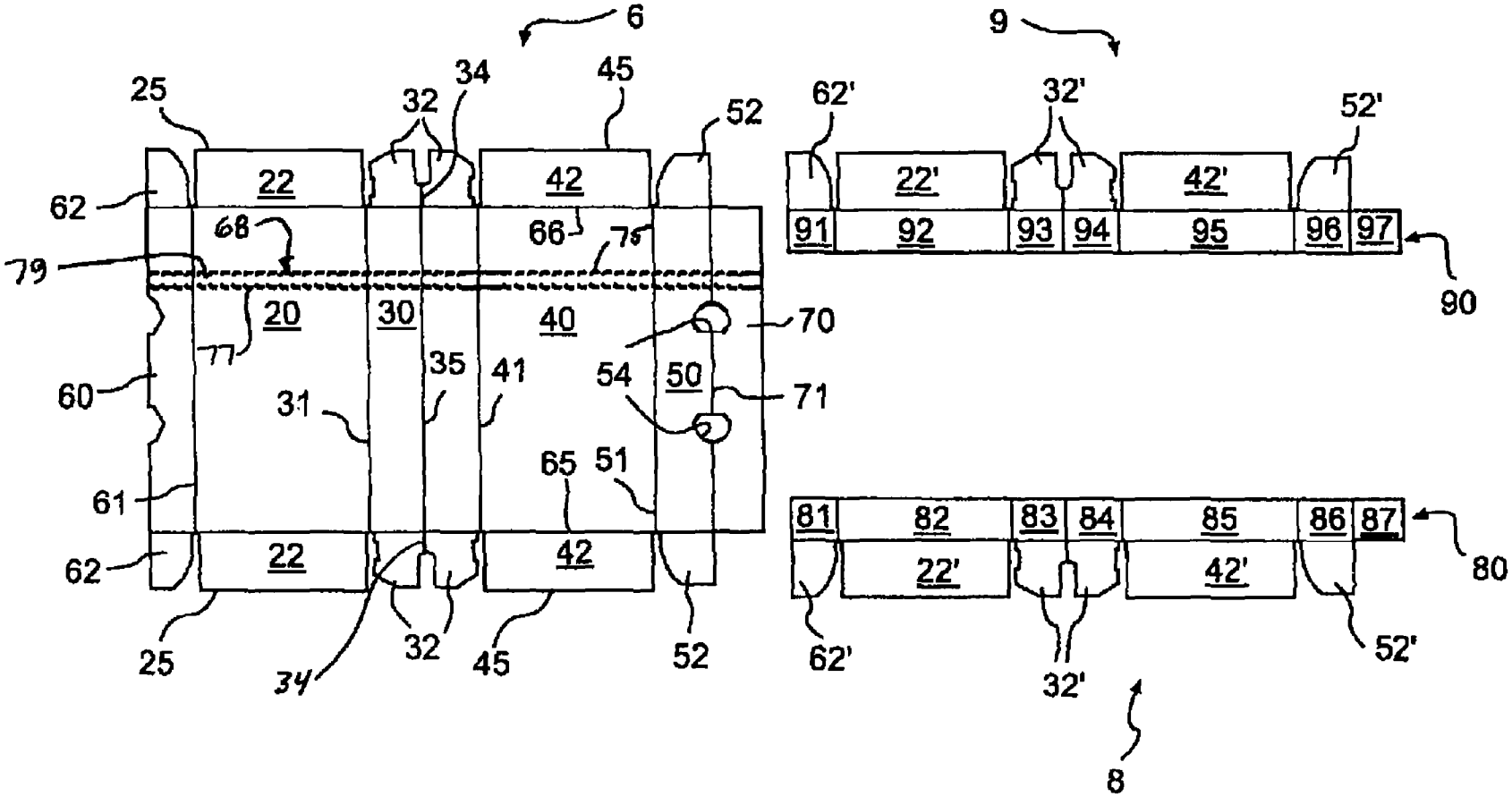
FIG. 1 is a plan view of primary and reinforcing blanks used to form a carton according to a first embodiment of the invention.

FIG. 1 is a plan view of interior sides of a primary blank 6 and first and second reinforcing blanks 8, 9. The blanks 6, 8, 9 are used to form a carton 100 (illustrated in FIGS. 3 and 4) according to a first embodiment of the invention. The interior sides of the blanks 6, 8, 9 will generally be disposed in the interior of the erected carton 100. The blanks 6, 8, 9 may be combined, for example, into a blank 10 (FIG. 2) having multi-ply sections formed from adhering or otherwise attaching the first and second reinforcing blanks 8, 9 to the primary blank 6. As discussed in further detail below, the primary blank 6 can have a periphery that is complementary to portions of the peripheries of the reinforcing blanks 8, 9.

Referring to FIG. 1, the primary blank 6 comprises a first side panel 20 foldably connected to a bottom panel 30 at a first transversely extending fold line 31, a second side panel 40 foldably connected to the bottom panel 30 at a second transverse fold line 41, and a first top panel 50 foldably connected to the second side panel 40 at a third transverse fold line 41. A second top panel 60 is foldably connected to the first side panel 20 at a fourth transverse fold line 61, and a third top panel 70 is foldably connected to the second top panel 50 at a fifth transverse fold line 71. The bottom panel 30 is foldable at its spine or midpoint at a sixth transverse fold line 35 extending across the width of the bottom panel.

The first side panel 20 is foldably connected at each end to a first side end flap 22. The bottom panel 30 is foldably connected at each end to two bottom end flaps 32. The bottom end flaps 32 are separated by transversely extending cuts 34, which more specifically typically are slits. The second side panel 40 is foldably connected at each end to a second side end flap 42. The first top panel 50 is foldably connected at each end to a first top end flap 52. The second top panel 60 is foldably connected at each end to a second top end flap 62. Handle apertures or knockouts 54 may be formed in one or both of the first and third top panels 50, 70. The end flaps 22, 32, 42, 52, 62 extend along a first and a second marginal area of the blank 6, and may be connected at first and second longitudinally extending fold lines 65, 66. The longitudinal fold lines 65, 66 may be straight, or they may be offset at one or more locations to account for, for example, blank thickness.

The primary blank 6 includes a line of separation (broadly "dispensing feature"), generally indicated 68 extending the length of the blank. In the embodiment of FIG. 1-4, the line of separation 68 comprises two spaced apart tear lines 75, 77 forming a tear strip 79 removably attached to the blank 6. In the illustrated embodiment, the tear strip 79 extends between the longitudinal ends of the blank and comprises a portion of the third top panel 7, the first top panel 50, the second side panel 40, the top panel 30, the first side panel 20, and the second top panel 60. The tear strip 79 could be otherwise shaped and arranged without departing from the scope of this invention. For example, the tear strip 79 could be replaced with a single tear line.

The first reinforcing blank 8 has a perimeter that may be in part generally complementary to a part of the first marginal area of the primary blank 6. The first reinforcing blank 8 is meant to overlie a part of the first marginal area of the primary blank 6 in order to reinforce the blank 6. The first reinforcing blank 8 includes a strip 80 of sequentially arranged rectangular reinforcing panels 81, 82, 83, 84, 85, 86, 87, and foldably attached reinforcing end flaps 62', 22', 32', 32', 42', 52'. During erection, the blank 8 is placed over the primary blank 6 so that the reinforcing end flaps 62', 22', 32', 32', 42', 52' of the first reinforcing blank 8 overlie and generally conform in shape to corresponding end flaps 62, 22, 32, 32, 42, 52, respectively, of the primary blank 6. The sequentially arranged reinforcing panels 81, 82, 83, 84, 85, 86, 87 are aligned with respective panels 60, 20, 30, 40, 50, 70 of the primary blank 6 so that the reinforcing blank 8 folds along the transverse fold lines 61, 31, 35, 41, 51, 71 in the primary blank 6.

Similarly, the second reinforcing blank 9 has a shape that may be in part generally complementary to a part of the second marginal area of the primary blank 6, and is meant to overlie and reinforce a second part of the first blank 6. The second reinforcing blank 9 includes a strip 90 of sequentially arranged rectangular reinforcing panels 91, 92, 93, 94, 95, 96, 97, and reinforcing end flaps 62', 22', 32', 32', 42', 52'. During erection, the second reinforcing blank 9 is placed over the primary blank 6 so that the reinforcing end flaps 62', 22', 32', 32', 42', 52' of the reinforcing blank 9 overlie and generally conform in shape to the end flaps 62, 22, 32, 32, 42, 52 of the primary blank 6. The reinforcing panels 91, 92, 93, 94, 95, 96, 97 are aligned with respective panels 60, 20, 30, 40, 50, 70 of the primary blank 6 so that the second reinforcing blank 9 folds along the transverse fold lines 61, 31, 35, 41, 51, 71 of the primary blank 6. Portions of the second reinforcing blank 9 may be, for example, a mirror image of the first reinforcing blank 8, and certain common reference numerals are therefore used in the reinforcing blanks 8 and 9.

Figure 2:
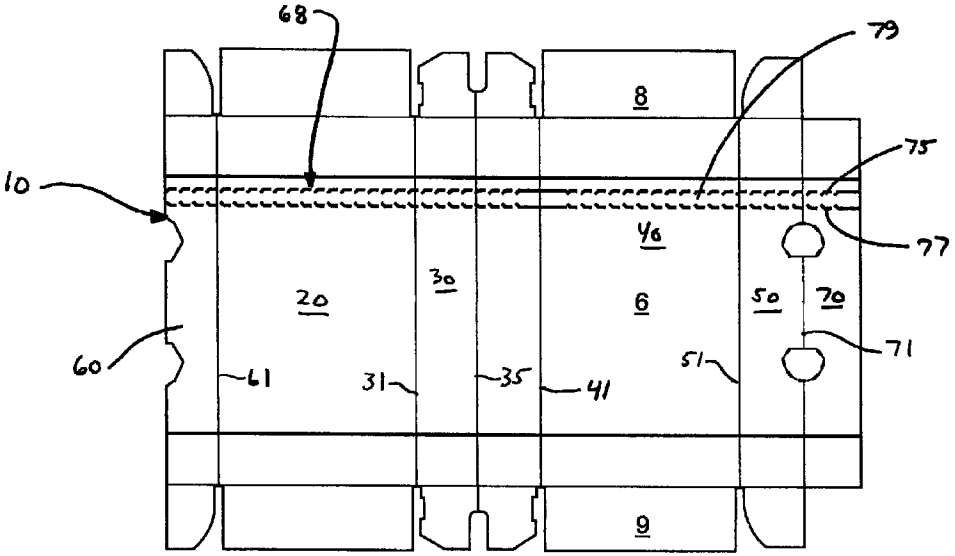
FIG. 2 illustrates the blanks of FIG. 1 combined into a multi-ply blank.

FIG. 2 illustrates the primary blank 6 and the reinforcing blanks 8, 9 combined into a multi-ply blank 10. In FIG. 2, the reinforcing blanks 8, 9 are placed over the respective first and second marginal areas of the primary blank 6 and secured thereto 6. Glue, for example, or other adhesives, or other means, may be used to secure the reinforcing blanks 8, 9 to the primary blank.

Figure 2A:
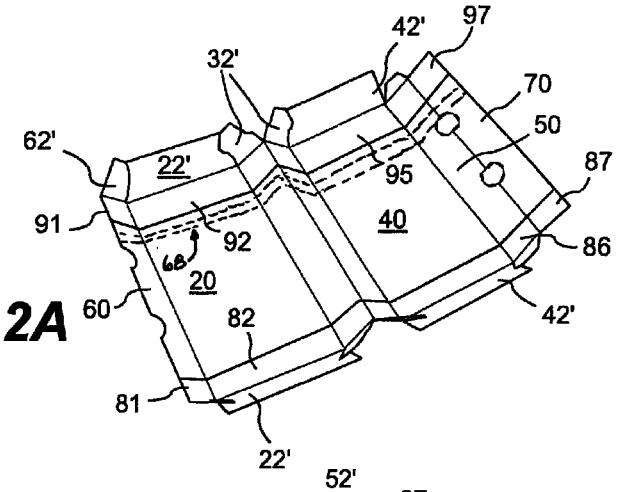
FIGS. 2A-2C illustrate erection of the first carton embodiment from the blank of FIG. 2.
Figure 2B:
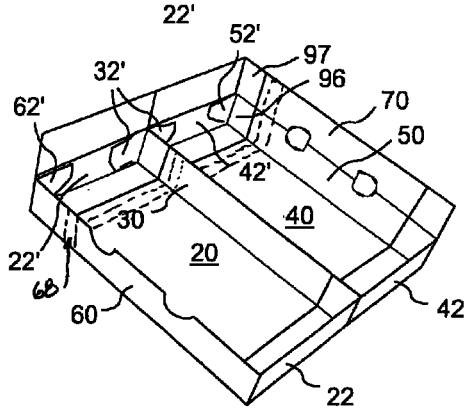
Figure 2C:
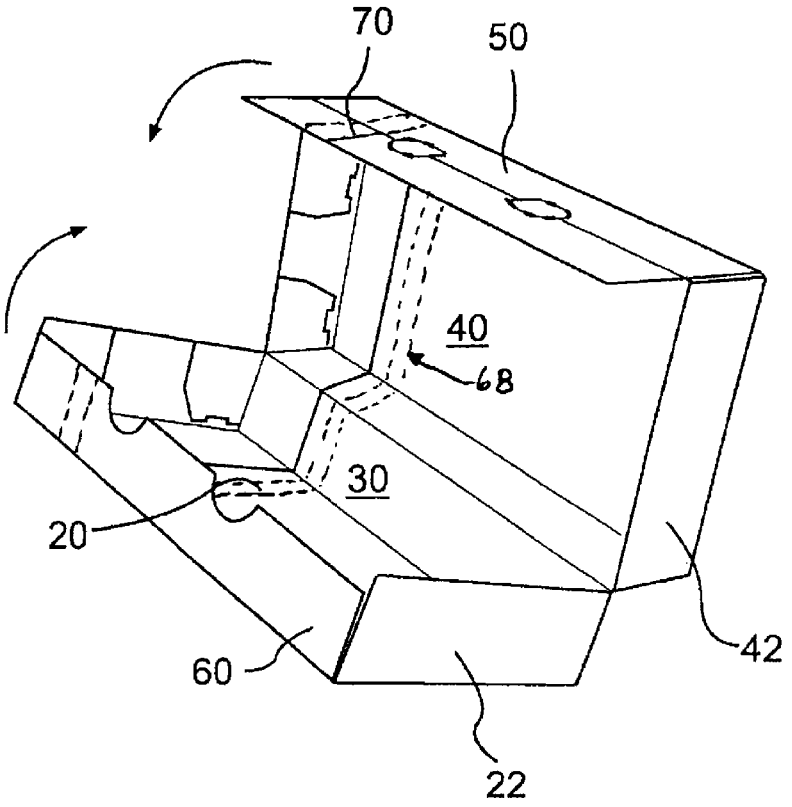
Figure 3:
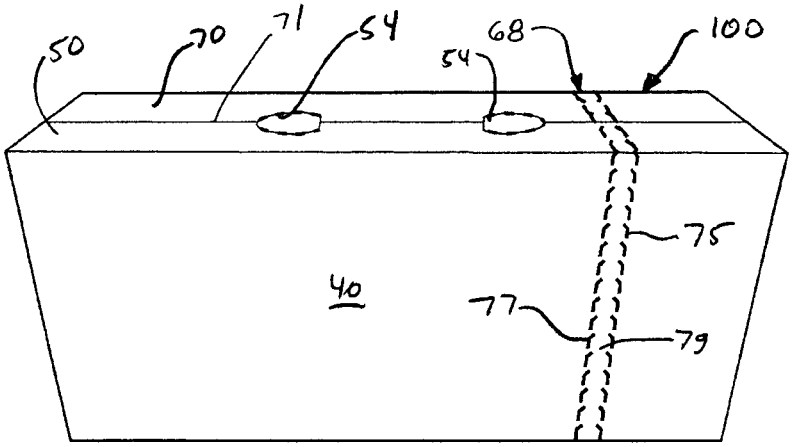
FIG. 3 illustrates the first carton embodiment.

FIGS. 2A-2C illustrate an exemplary method of erecting the multi-ply blank 10 (FIG. 2) into the carton 100. Certain elements of the blanks 6, 8, 9 referred to in the following description may not be visible in FIGS. 2A-2C, and such elements can be found in FIGS. 1 and 2. FIG. 2 illustrates the multi-ply blank 10 ready for erection. In FIG. 2A, the end flaps 22, 32, 32, 42, 52, 62 (along with the reinforcing end flaps 62', 22', 32', 32', 42', 52') and the top panels 50, 60, 70 are folded inwardly. In FIG. 2B, the exterior sides of the end flaps 62, 32 are adhered to the interior sides of the reinforcing end flaps 22', and the exterior sides of the end flaps 32 and 52 are adhered to the interior sides of the reinforcing end flaps 42'. FIG. 2C illustrates the partially erected blank 10 being folded in the direction of the arrows to bring the opposed halves of the partially erected carton together. The interior side of the third top panel 70 may be adhered to the exterior side of the second top panel 60 to complete erection of the carton 100, as shown in FIG. 3. One or more articles P (FIG. 4) may be loaded into the carton 100 at any time prior to fully closing the carton 100.

Figure 4:
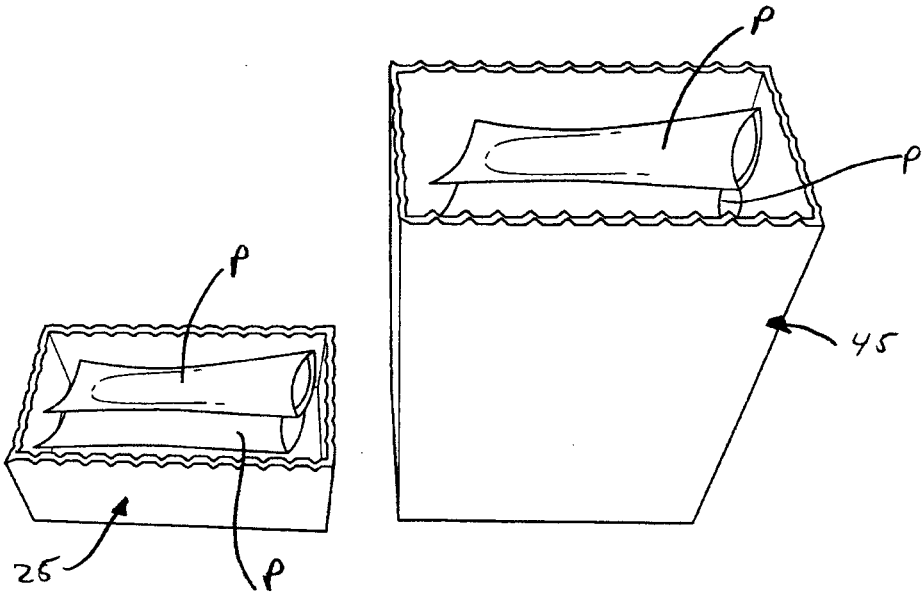
FIG. 4 illustrates the first carton embodiment converted to a dispensing carton.

FIGS. 3 and 4 illustrate the erected carton 100. The carton 100 may be, for example, generally parallelepipedal, and may have a closed or nearly closed configuration. In FIG. 3, the carton 100 rests on the bottom panel 30. The first and second side end flaps 22, 42 along with the reinforcing end flaps 22', 42' adhered thereto close the ends 53, 55 of the carton 100. The optional handle apertures 54 are accessible in the top panels 50, 70.

FIG. 4 illustrates the erected carton 100 with the tear strip 79 removed and the carton converted from a shipping carton to a two-piece dispensing carton. In the illustrated embodiment, the carton 100 is converted to the dispensing carton by grasping and removing the tear strip 79 to separate the carton into a first dispensing portion 25 and a second dispensing portion 45. Each of the first and second dispensing portion 25, 45 contains a respective subset of the articles P. As shown in FIG. 4, the first dispensing portion 25 is smaller than the second dispensing portion 45. Both the first and second dispensing portions 25, 45 have an open top for access to articles P contained therein. It is understood that the dispensing portions 25 could be alternatively shaped and sized. For example, in alternative embodiments, the two dispensing portions may be approximately equal in size. Further, the dispensing portions may be foldably attached along a fold line and more than two dispensing portions may be provided without departing from the scope of this invention.

The reinforcing blank 9, as well as the reinforcing blank 8 (illustrated in FIG. 1), provides additional strength and rigidity to the carton 100. For example, when the carton 100 is supported on the bottom panel 30 as shown in FIG. 3, the panels and flaps 92, 95, 22', 42' of the reinforcing blank 9, and the reinforcing panels and flaps 82, 85, 22', 42' of the reinforcing blank 8 extend vertically within the carton 100 interior and provide significant strength against vertical axial compression. Similarly, if the carton 100 is supported on either of its side panels 20, 40, the first and second reinforcing blanks 8, 9 provide significant additional axial compressive strength and rigidity to the primary blank 6.

Figure 5:
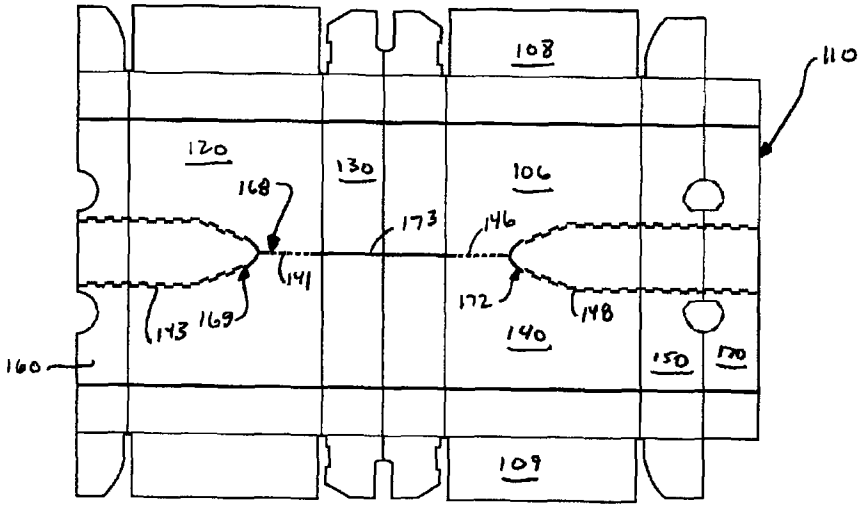
FIG. 5 is a plan view of primary and reinforcing blanks used to form a carton according to a second embodiment of the invention.

FIG. 5 illustrates a multi-ply blank 110, according to a second embodiment of the invention. The blank 110 comprising a primary blank 106 and first and second reinforcing blanks 108, 109. In FIG. 5, like reference numbers as to the reference numbers shown in FIGS. 1 and 2 indicate like or similar elements, with the reference numbers in FIG. 5 being preceded by "1." The resultant multi-ply blank formed from the primary and reinforcing blanks 106, 108, 109 can be erected into a carton 200 (FIGS. 6-8) using the method shown in FIGS. 2A-2C.

The primary blank 106 is substantially identical to the primary blank 6, except the blank includes a line of separation (broadly "dispensing feature") 168 comprising a first tear line 169 in the first side panel 120 and the second top panel 160, and a second tear line 172 in the second side panel 140 and the top panels 150, 170. The two tear lines 169, 172 are connected by a longitudinal fold line 173 in the bottom panel 130 of the primary blank 106. The first tear line 169 has a first portion 141 extending longitudinally from the fold line 131 into the first side panel 120 and a second portion 143. The second portion 143 is generally V-shaped and extends from the first portion 141 into the second top panel 160 to the edge of the blank 106. The second tear line 172 has a first portion 146 extending longitudinally from fold line 141 into the second side panel 140 and a second portion 148 that is generally V-shaped and extending from the first portion across the first and second top panels 150, 170 to the edge of the blank 106.

Figure 6:
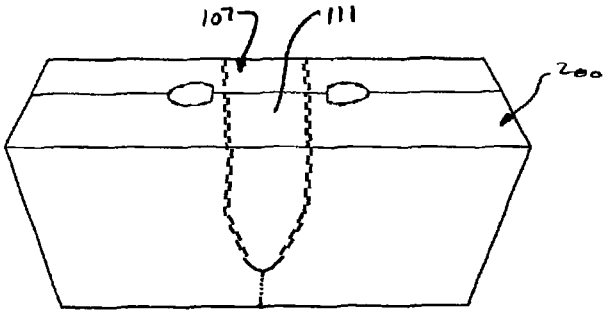
FIGS. 6-8 illustrate the second carton embodiment.
Figure 7:
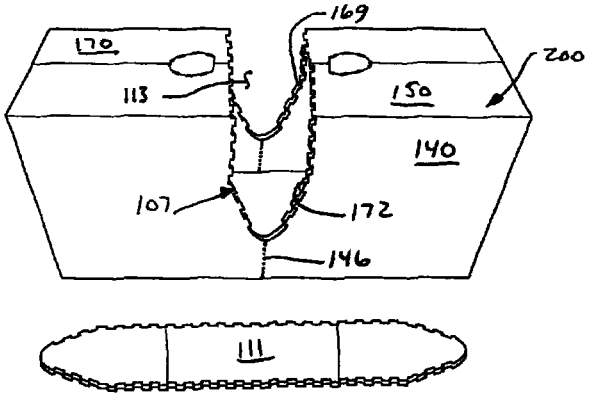
Figure 8:
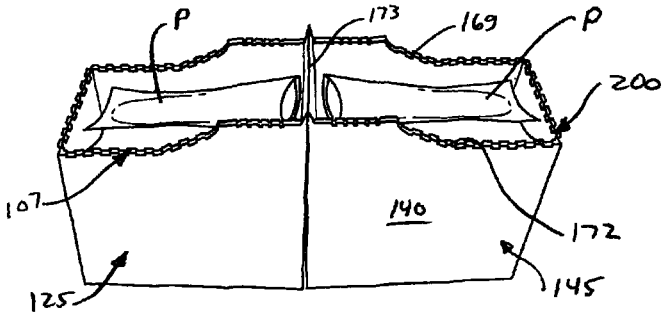

As shown in FIGS. 6-8, the carton 200 has a dispenser 107 including a removable dispenser panel 111 for forming a dispenser opening 113 in the carton. The dispenser panel 111 is formed in the top panels 150, 160, 170 and the first and second side panel 120, 140 by the of the tear lines 169, 172. To convert the carton 200 from the shipping carton to the dispensing carton, the dispenser panel 111 is removed by tearing along the respective second portions 143, 148 of the first and second tear lines 169, 172. Next, the carton 200 is further separated along respective first portions 141, 146 of the tear lines 169, 172. The carton 105 is then folded along fold line 173 to form the first and second dispensing portions 125, 145 that are foldably connected. As in the previous embodiments, the first dispensing portion 125 contains a first subset of articles P and the second dispensing portion 145 contains a second subset of articles to be dispensed from the carton 105. As shown in FIG. 8, the dispensing portions 125, 145 have an open top for grasping of articles P from the carton 106 and a profile formed by the dispenser 107 that facilitates access to the articles. In the illustrated embodiment, the first and second dispensing portions 125, 145 are adjacent each other and are foldably attached at fold line 173. Alternatively, the dispensing portions 125, 145 could be separated (e.g., the fold line 173 could be replaced with a tear line) without departing from the scope of the invention.

Figure 9:
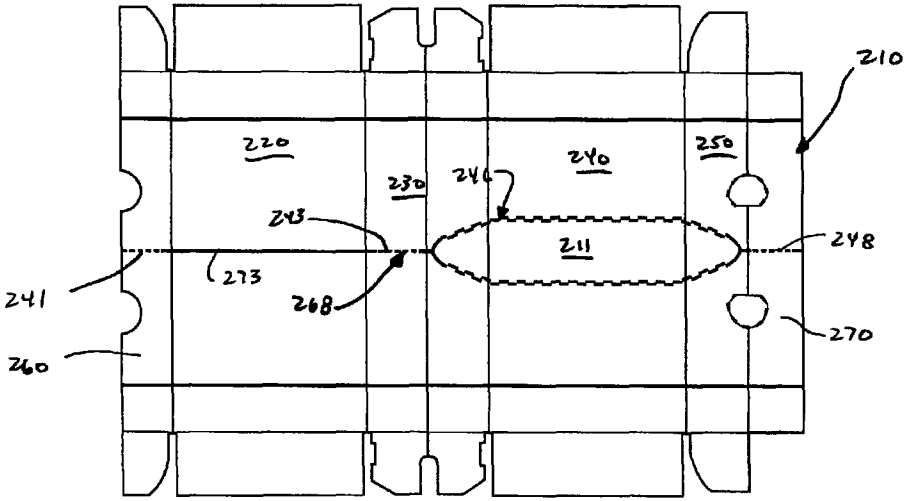
FIG. 9 is a plan view of primary and reinforcing blanks used to form a carton according to a third embodiment of the invention.
Figure 10:
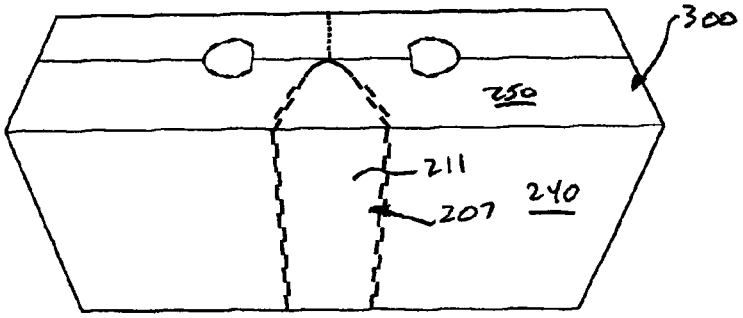
FIGS. 10-12 illustrate the third carton embodiment.
Figure 11:
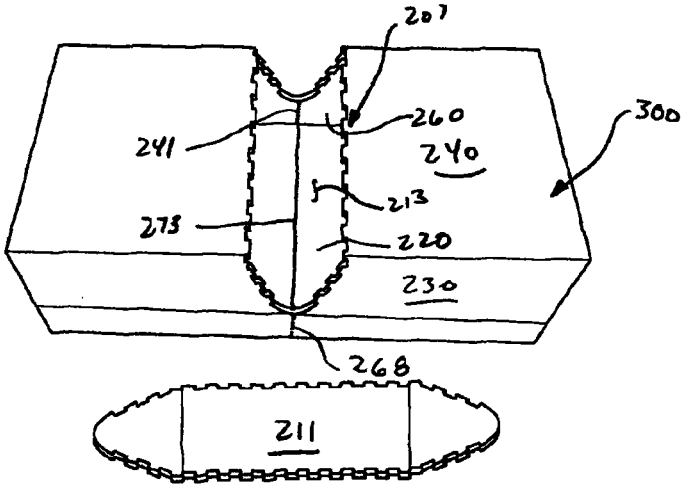
Figure 12:
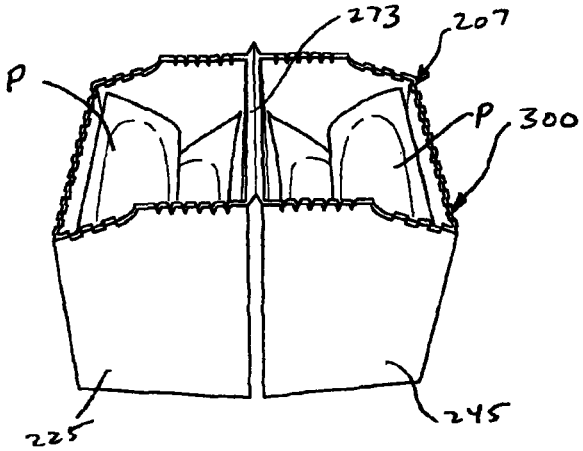

FIG. 9 shows a multi-ply blank 210 according to a third embodiment of the invention. The third embodiment is like the prior embodiments, except for variations noted and variations that will be apparent to those of ordinary skill in the art. For example, the blank 210 is formed into a shipping and dispensing carton 300 (FIGS. 10-12) in a similar manner as the previous embodiments. The carton 300 includes a dispenser 207 having a removable dispenser panel 211 forming a dispenser opening 213. In the illustrated embodiment, the dispenser panel 211 comprises a portion of the second side panel 240, the bottom panel 230, and the second top panel 250. The blank 210 includes a line of separation 268 (broadly "dispensing feature") that includes a longitudinal tear line 241 in the second top panel 260, a longitudinal tear line 243 in the bottom panel 230, and a longitudinal tear line 248 in the third top panel 270. The line of separation 268 includes a dispenser tear line 246 in the bottom panel 230, the second side panel 240, and the first top panel 250. A longitudinal fold line 273 in the first side panel 220 connects the tear lines 241, 243. The carton 300 is converted from the shipping carton to the dispensing carton having the two foldably attached dispensing portion 225, 245 (FIG. 12) in a similar manner as the previous embodiment.

Figure 13:
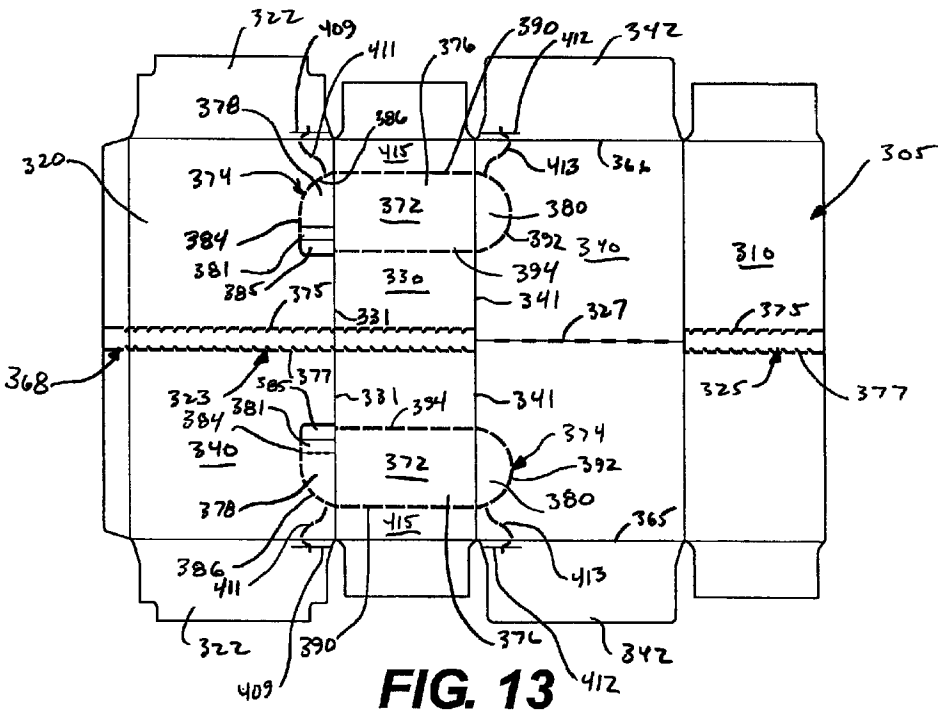
FIG. 13 is a plan view of a blank used to form a carton according to a fourth embodiment of the invention.

FIG. 13 shows a blank 305 for a fourth embodiment of the invention. In accordance with the fourth embodiment, the blank 305 is a single ply. Nonetheless, the blank 305 is formed into a shipping and dispensing carton 400 (FIGS. 14-16) in a similar manner as the previous embodiment. In this embodiment, the line of separation 368 comprises a tear strip that includes a first portion 323 in the top panel 330 and the first side panel 340 of the blank 305, and a second portion 325 in the bottom panel 310. Each of the first and second portions 323, 325 of the tear strip 368 extends generally in the longitudinal direction and is formed by respective spaced-apart, longitudinally extending tear lines 375, 377. The first portion 323 extends longitudinally from the lateral fold line 341 across the top panel 330 and the first side panel 320, and across an adhesive panel 360 adjacent to the first side panel to the edge of the blank 305. The second portion 325 of the tear line 368 extends from the lateral fold line 351 across the bottom panel 350 to the edge of the blank 305. A longitudinal fold line 327 connects the first portion 323 to the second portion 325 of the tear line 368.

The carton 400 includes two dispensers 307, 309. In the illustrated embodiment, the two dispensers 307 include identical components and are arranged to be a mirror image of each other, thus common references numerals are used to indicate common components of the dispensers. Each dispenser 307 includes a dispenser panel, generally indicated at 372, removably attached to the blank 1 at a tear line, generally indicated at 374. When the dispenser panel 372 is removed from the carton 400, a dispenser opening 375 (FIGS. 15 and 16) is exposed to allow the containers C to be selectively dispensed from the carton. In the illustrated embodiment, the dispenser panel 372 includes a first portion 376 in the top panel 330 of the blank 1, a second portion 378 in the first side panel 320, and a third portion 380 in the second side panel 340. The dispenser panel 372 includes a foldable flap 381 foldably attached to the third portion 380 at a lateral fold line 383. Each dispenser 307 includes an access opening 385 in the first side panel 320 for grasping the flap 381 to initiate removal of the dispenser panel 372 from the carton 400.

In the illustrated embodiment, the tear line 374 includes a first portion 384 extending in the lateral direction in the side panel 320 from the access opening 385 to a curved second portion 386. The second portion 386 extends from the first portion 384 to the longitudinal fold line 331. The tear line 374 includes a third portion 390 extending laterally in the top panel 330 between the longitudinal fold line 331 and the longitudinal fold line 341. A fourth portion 392 of the tear line 374 extends from the intersection of the third portion 390 with the longitudinal fold line 341. The fourth portion 392 of the tear line 374 is curved and extends down from the longitudinal fold line 341 into the side panel 340 and extends upward to the fold line. In the illustrated embodiment, the fourth portion 392 is generally semicircular in shape but it is understood that it may be otherwise shaped without departing from the scope of this invention. The tear line 374 includes a fifth portion 394 extending generally in the lateral direction in the top panel 330 between the intersection of the fourth portion 392 with the longitudinal fold line 341 to the access opening 385 in the side panel 320. In the illustrated embodiment the fifth portion 394 of the tear line 374 is generally parallel to the fourth portion, but the tear line may be otherwise sized and shaped without departing from the scope of this invention.

In the illustrated embodiment, the dispensers 307 each include a hinge, generally designated 405 that allows the dispenser opening 375 of each dispenser to be expanded to facilitate access to the container in the carton 400. Each side end flap 322, 342 of the blank 305 includes a respective longitudinal fold line 409, 412 parallel to the longitudinal fold lines 365, 366. The hinge 405 includes a first curved tear line 411 that extends from the second portion 386 of the tear line 374 in the first side panel 320, across the lateral fold line 365, 366 and across the longitudinal fold line 409 in the end flap 322. A second curved tear line 413 extends from the fourth portion 392 of the tear line 374 in the second side panel 340, across the lateral fold line 365, 366 and across the longitudinal fold line 412 in the end flap 342. The first and second curved tear lines 411, 413, respective portions of the second and fourth portions 386, 392 of the tear line 374, and the third portion 390 of the tear line define a pivotable flap 415 of the carton 400. The pivotable flap 415 includes a portion of the first side panel 320, a portion of the top panel 330, a portion of the second side panel 340, and portions of the end flaps 322, 342 forming the closed end of the carton 400. The pivotable flap 415 is generally pivotable at the closed end of the carton 400 about the longitudinal fold lines 409, 412 of the overlapped side end flaps 322, 342 forming the closed end of the carton to expand the dispenser opening 375. The various features one or both of the dispensers 307, 309 may be otherwise shaped and arranged, or may be omitted, without departing from the scope of this invention.

Figure 14:
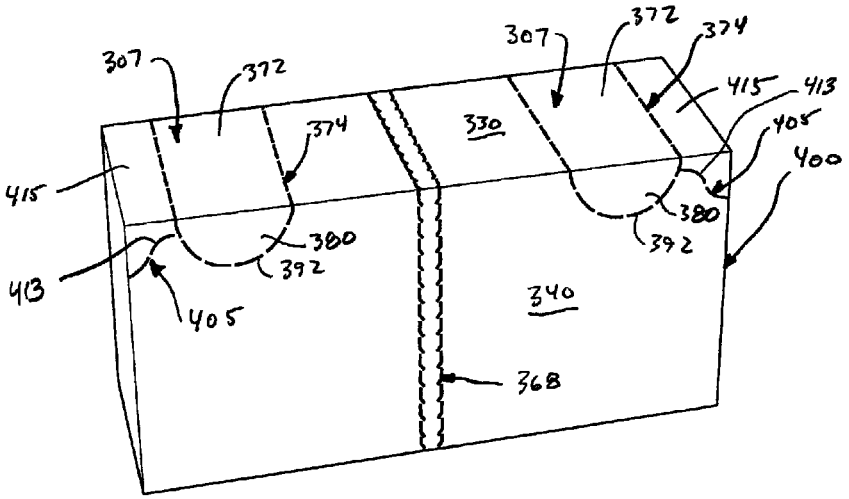
FIGS. 14-16 illustrate the fourth carton embodiment.
Figure 15:
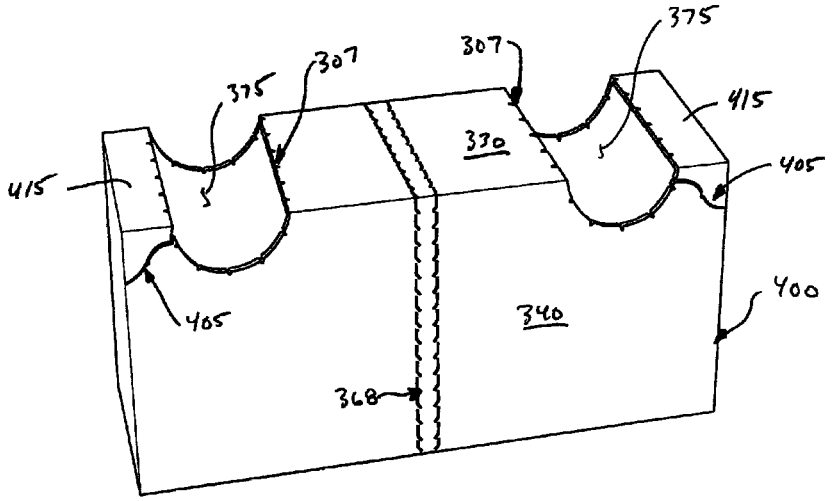
Figure 16:
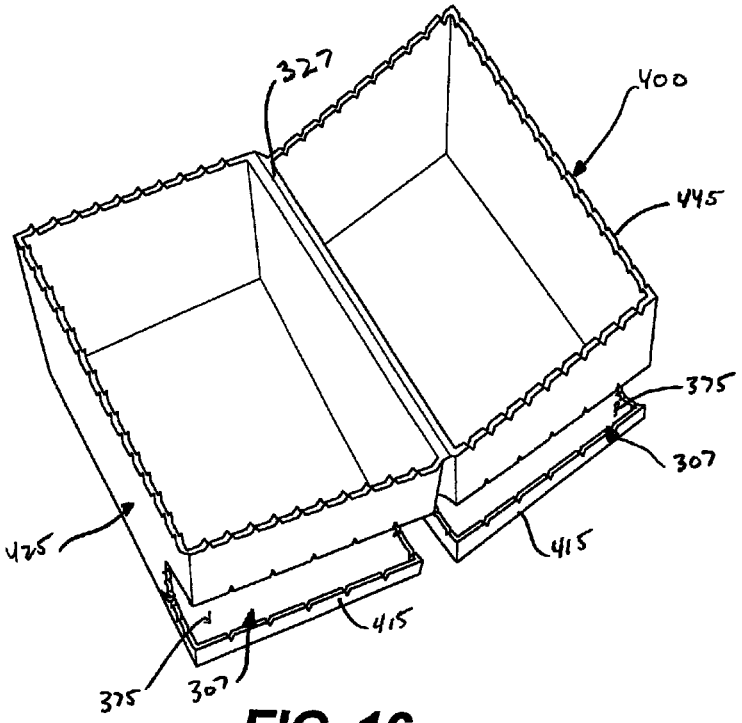

As shown in FIGS. 14-16, the carton 400 is converted from a shipping container to a dispensing container (FIG. 14) by removing the first and second portions 325, 325 of the tear 368 and folding the carton along fold line 327 to position the first and second dispensing portions 425, 445 adjacent to each other. The first dispensing portion 425 has one of the dispensers 307 formed therein, and the second portion 445 has the other of the dispensers formed therein. Containers or other articles may be dispensed from either or both of the first and second dispensing portions 425, 445 through the respective open top of the dispensing portion or through the respective dispenser opening 375 of the dispenser 307.

Figure 17:
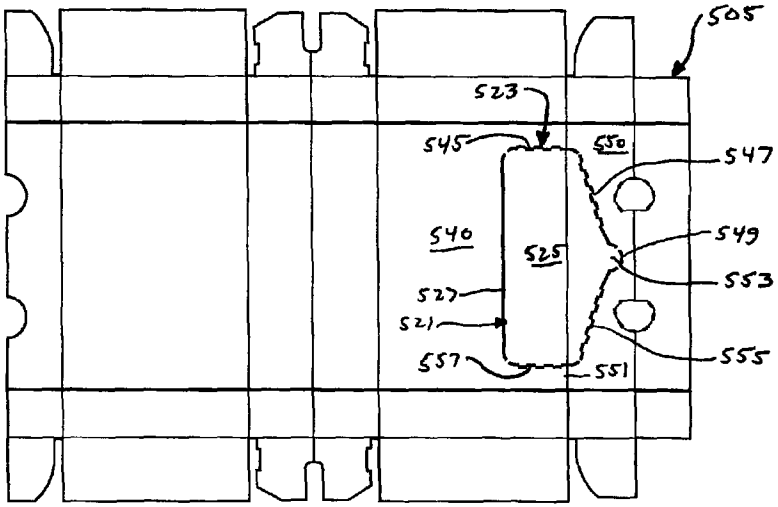
FIG. 17 is a plan view of primary and reinforcing blanks used to form a carton according to a fifth embodiment of the invention.

FIG. 17 shows a multi-ply blank 505 for a fifth embodiment of the invention. The fifth embodiment is like the first embodiment, except for variations noted and variations that will be apparent to those of ordinary skill in the art. For example, the blank 505 is formed into a shipping and dispensing carton 600 (FIGS. 18 and 19) in a similar manner as the first embodiment. In the fifth embodiment, the blank 505 includes a dispenser 521 (broadly "dispensing feature") shaped to form a dispenser opening 519 (FIG. 19) in the front and top of the carton 600. The dispenser 521 includes a tear line, generally indicated at 523, forming a dispenser panel 525 comprising a portion of the second side panel 540 and the top panel 550 of the blank 505. The dispenser panel 525 is foldably attached to the second side panel 540 by a lateral fold line 527. The tear line 523 includes a first portion 545 extending longitudinally from a first end of the fold line 527 and a second portion 547 extending obliquely from the intersection of the first portion with the fold line 551. A third portion 549 of the tear line 523 is curved and defines an actuation panel 553 in the top panel 550. The tear line 523 includes a fourth portion 555 extending obliquely from the bottom of the third portion 549 to the fold line 551, and a fifth portion 557 extending longitudinally from the fourth portion to an end of the lateral fold line 527.

Figure 18:
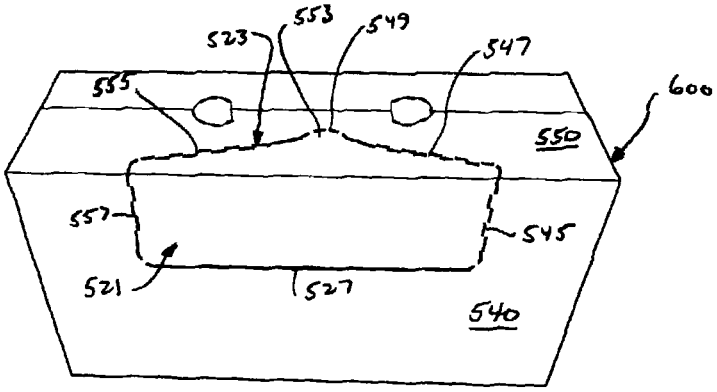
FIGS. 18 and 19 illustrate the fifth carton embodiment.
Figure 19:
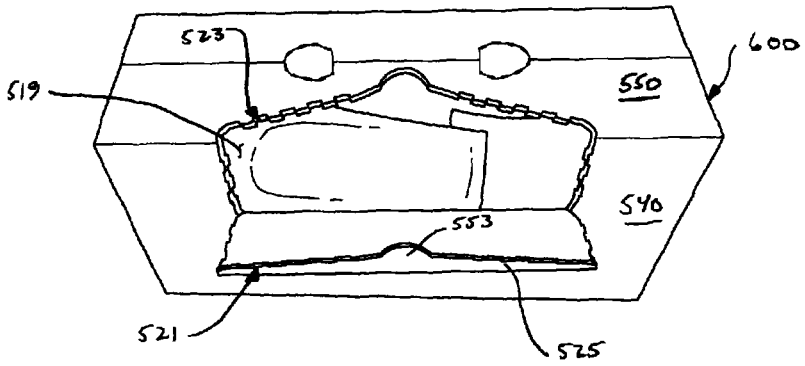

As shown in FIGS. 18 and 19, the dispenser 521 is activated by folding the actuation panel 553 and grasping the dispenser panel 525 to tear the carton 600 at tear line 523 to create the dispenser opening 519 in the carton. Articles P or other containers may be removed through the dispenser opening 519. Optionally, the dispenser panel 525 may be partially or fully removed from the carton 600 by further tearing along fold line 527 without departing from the scope of this invention.

Figure 20:
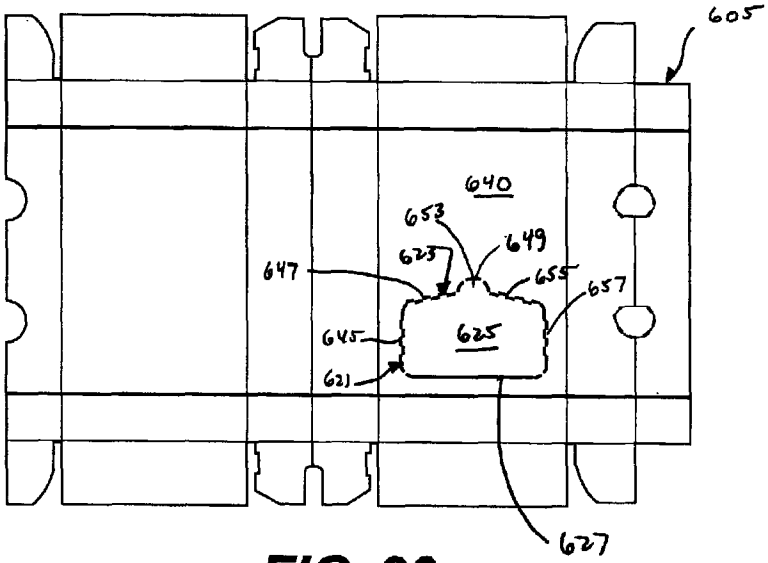
FIG. 20 is a plan view of primary and reinforcing blanks used to form a carton according to a sixth embodiment of the invention.
Figure 21:
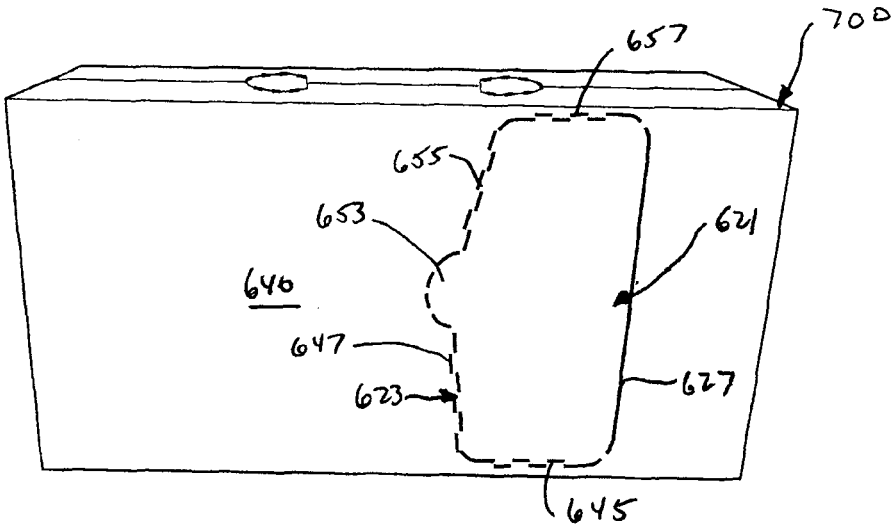
FIGS. 21 and 22 illustrate the sixth embodiment of the invention.
Figure 22:
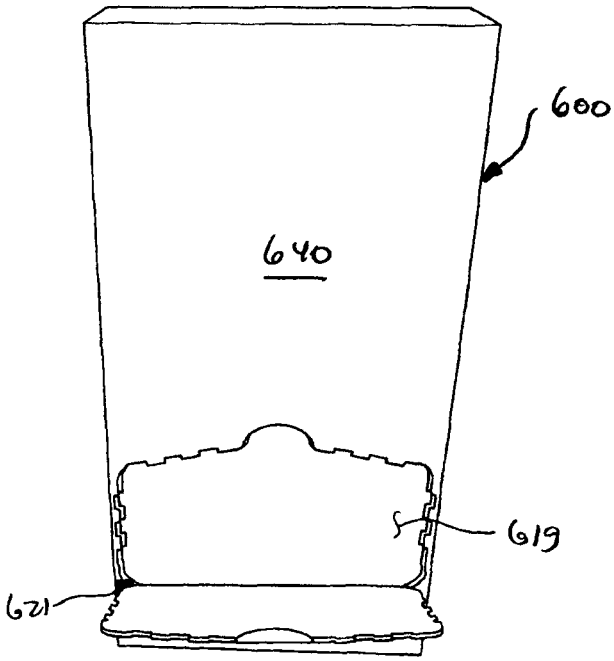

FIG. 20 shows a multi-ply blank 605 for a sixth embodiment of the invention. For example, the blank 605 is formed into a shipping and dispensing carton 700 (FIGS. 21 and 22) in a similar manner as the previous embodiment. In the sixth embodiment, the carton 600 includes a dispenser 621 (broadly "dispensing feature") shaped to form a dispenser opening 619 in the front of the carton. The dispenser 621 includes a tear line, generally indicated at 623, forming a dispenser panel 625 comprising a portion of the second side panel 640. The dispenser panel 625 is foldably attached to the second side panel 640 by a longitudinal fold line 627. The tear line 623 includes a first portion 645 extending laterally from a first end of the fold line 627 and a second portion 647 extending obliquely from the first portion. A third portion 649 of the tear line 623 is curved and defines an actuation panel 653 in the side panel 640. The tear line 623 includes a fourth portion 655 extending obliquely from the bottom of the third portion 649 and a fifth portion 657 extending laterally from the fourth portion to an end of the longitudinal fold line 627.

The dispenser 621 is activated by tearing at tear line 623 and folding the dispenser panel at fold line 627 to create the dispenser opening 619 in the front of the carton 700 to dispense articles therefrom. As with the other embodiments described herein, the dispenser 621 may be otherwise shaped and positioned without departing from the scope of this invention.

Figure 23:
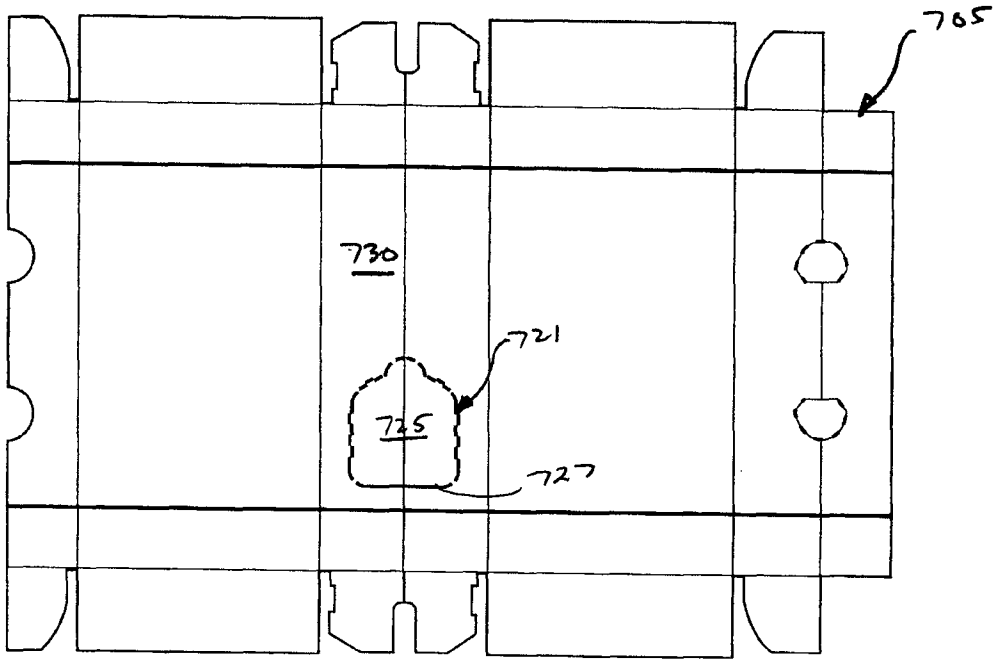
FIG. 23 is a plan view of primary and reinforcing blanks used to form a carton according to a seventh embodiment of the invention.

FIG. 23 shows a multi-ply blank 705 for a seventh embodiment of the invention. The seventh embodiment is like the sixth embodiment, except for variations noted and variation that will be apparent to those of ordinary skill in the art. For example, the blank 705 is formed into a shipping and dispensing carton (not shown) in a similar manner as the previous embodiments. In this embodiment, the blank 705 includes a dispenser 721 (broadly "dispensing feature") including a dispenser panel 725 similarly shaped as the previous embodiment but being located in the bottom panel 730 of the blank 705. The dispenser 721 forms a dispenser opening in the bottom panel 730 of the blank 705 when the blank is erected into the carton. In the illustrated embodiment, the dispenser panel 725 is foldably attached to the bottom panel 730 by a longitudinal fold line 727. The dispenser may be otherwise shaped and positioned without departing from the scope of this invention.

Figure 24:
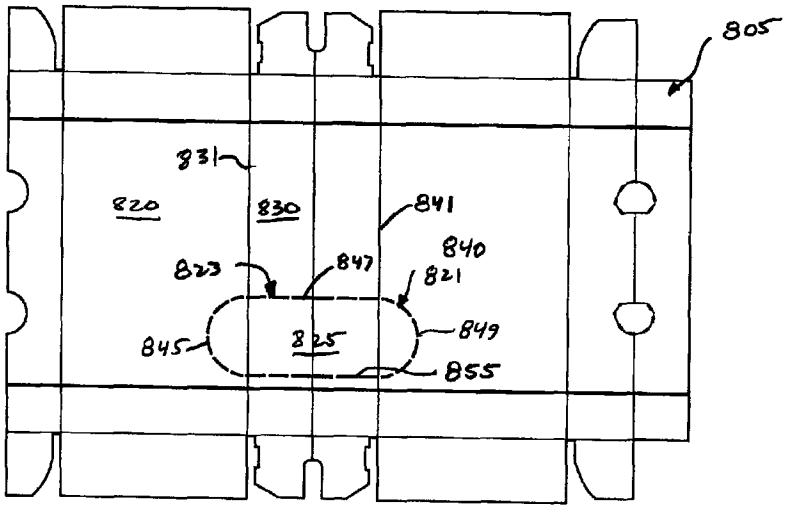
FIG. 24 is a plan view of primary and reinforcing blanks used to form a carton according to an eighth embodiment of the invention.
Figure 25:
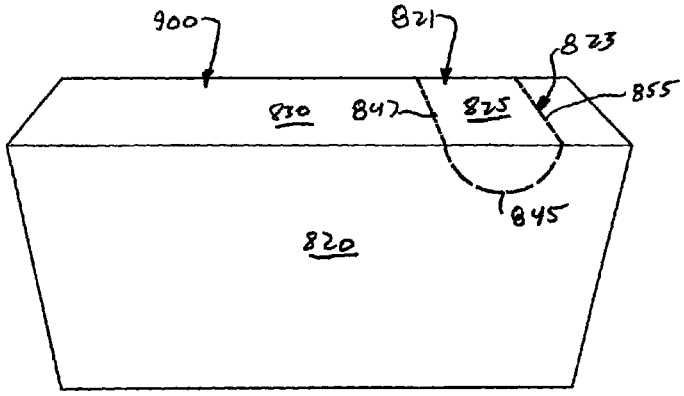
FIGS. 25 and 26 illustrate the eighth carton embodiment of the invention.

FIG. 24 shows a multi-ply blank 805 for an eighth embodiment of the invention. The eighth embodiment is like the seventh embodiment, except for variations noted and variations that will be apparent to those of ordinary skill in the art. For example, the blank 805 is formed into a shipping and dispensing carton 900 (FIGS. 25 and 26) in a similar manner as the previous embodiments. In this embodiment, the blank 805 includes a dispenser 821 (broadly "dispensing feature") shaped to form a dispenser opening 819 (FIG. 26) in the carton. The dispenser 821 includes a tear line, generally indicated at 823, forming a dispenser panel 825 comprising a portion of the second side panel 840, the bottom panel 830, and the first side panel 820 of the blank 805. The tear line 823 includes a first portion 845 that is curved and extends from the fold line 831 into the first side panel 820 and a second portion 847. The second portion 847 extends longitudinally from a first end of the first portion 845 across the bottom panel 830 to the fold line 841. A third portion 849 is curved and extends from the fold line 841 into the second side panel 840. A fourth portion 855 in the bottom panel 830 is parallel to the second portion 847 and connects respective ends of the curved first and third portions 845, 849. It is understood that the tear line 823 and the dispenser panel 825 could be otherwise shaped and arranged. For example, the dispenser 821 could be positioned so that the tear line 823 forms the dispenser panel 825 in the top panels 850, 860, 870 so that the dispenser opening 819 is in the top of the carton 900. Also, the dispenser 821 could include a hinge as in the embodiments of FIGS. 13-16 to allow the dispenser opening 819 to be expanded.

Figure 26:
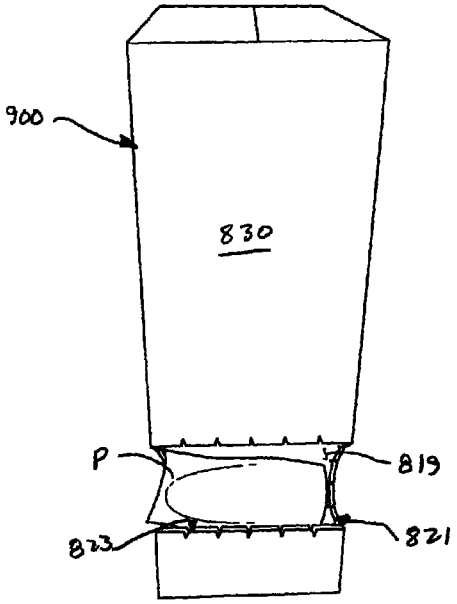

As shown in FIG. 26, the dispenser 821 is activated by grasping the dispenser panel 825 to tear the carton 900 at tear line 823 to create the dispenser opening 819 in the carton 900. Articles or containers P may be removed from the carton 900 through the dispenser opening 819. Alternatively, the dispenser panel 825 may remain foldably attached to the carton 900 by only partially tearing the dispenser panel 825 along tear line 823.

The blanks according to the present invention can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described herein. The blank can also be laminated or coated with one or more sheet-like materials at selected panels or panel sections.

In accordance with the above-described embodiments of the present invention, a fold line can be any substantially linear, although not necessarily straight, form of weakening that facilitates folding therealong. More specifically, but not for the purpose of narrowing the scope of the present invention, fold lines can include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present invention for each of the tear lines to be replaced with a continuous slit, or the like. For example, a cut line can be a continuous slit or could be wider than a slit without departing from the present invention.

The above embodiments may be described as having one or more panels adhered together by glue during erection of the carton embodiments. The term "glue" is intended to encompass all manner of adhesives commonly used to secure carton panels in place.

The foregoing description of the invention illustrates and describes various embodiments of the present invention. As various changes could be made in the above constructions without departing from the scope of the invention, it is intended that all matter contained in the above description or shown in the accompanying drawings shall be interpreted as illustrative and not in a limiting sense. Furthermore, the scope of the present covers various modifications, combinations, alterations of the above-described embodiments that are within the scope of the claims. Additionally, the disclosure shows and describes only selected embodiments of the invention, but it is to be understood that the invention is capable of use in various other combinations, modifications, and environments and is capable of changes or modifications within the scope of the inventive concept herein, commensurate with the above teachings, and/or within the skill or knowledge of the relevant art. Further certain features and characteristics of each embodiment may be interchanged and applied to other embodiments of the invention with out departing from the scope of the invention.

What is claimed is:

1. A carton for holding a plurality of articles, the carton being formed from a primary blank and at least one reinforcing blank, the carton comprising:

a plurality of panels that extends at least partially around an interior of the carton, the plurality of panels comprises at least a bottom panel and a transverse fold line extending along a midpoint of the bottom panel;

at least one first end flap foldably connected to at least one panel of the plurality of panels along a first longitudinal fold line, the at least one first end flap at least partially closing a first end of the carton;

at least one second end flap foldably connected to at least one panel of the plurality of panels along a second longitudinal fold line, the at least one second end flap at least partially closing a second end of the carton;

the at least one reinforcing blank comprises at least a first reinforcing blank and a second reinforcing blank, the first reinforcing blank being at least partially adhered to the primary blank at the first end of the carton forming a first multi-ply portion of the carton, at least a portion of each panel of the plurality of panels comprising a portion of the first multi-ply portion, and at least a portion of the at least one first end flap comprising a portion of the first multi-ply portion, and the second reinforcing blank being at least partially adhered to the primary blank at the second end of the carton forming a second multi-ply portion of the carton, at least a portion of each panel of the plurality of panels comprising a portion of the second multi-ply portion, and at least a portion of the at least one second end flap comprising a portion of the second multi-ply portion; and a dispensing feature extending in the primary blank, the dispensing feature comprising a tear strip extending in the primary blank for separating the carton into at least a first dispensing portion and a second dispensing portion, wherein the first dispensing portion and the second dispensing portion are for being free from contact with one another when the tear strip is removed, the first dispensing portion comprises the first multi-ply portion of the carton, the second dispensing portion comprises the second multi-ply portion of the carton, and the first dispensing portion is smaller than the second dispensing portion.

2. The carton of claim 1, wherein the tear strip comprises at least two longitudinal tear lines.

3. The carton of claim 2, wherein the tear strip extends longitudinally across at least a portion of the primary blank.

4. The carton of claim 1, wherein the tear strip extends longitudinally across the plurality of panels.

5. The carton of claim 4, wherein the plurality of panels comprises at least a first top panel at least partially overlapping a second top panel, the tear strip comprising a first portion in the first top panel and a second portion in the second top panel, the first portion of the tear strip at least partially overlapping the second portion of the tear strip.

6. The carton of claim 5, further comprising handle features in at least one of the first top panel and the second top panel.

7. The carton of claim 4, wherein the tear strip extends proximate to a longitudinal edge of the first reinforcing blank.

8. The carton of claim 1, wherein the at least one first end flap comprises a plurality of first end flaps comprising a plurality first primary end flaps in the primary blank overlapping a plurality of first reinforcing end flaps in the first reinforcing blank.

9. The carton of claim 1, wherein the first multi-ply portion of the carton is spaced apart from the at least one second end flap.

10. The carton of claim 1, wherein the tear strip extends in an intermediate portion of the primary blank that is free from contact with the first reinforcing blank and the second reinforcing blank, the tear strip extends in a generally longitudinal direction adjacent an edge of the first reinforcing blank so that the second dispensing portion comprises substantially all of the intermediate portion of the primary blank after the tear strip is removed.

11. A carton blank for forming a carton for holding a plurality of articles, the carton blank being formed from a primary blank and at least one reinforcing blank, the carton blank comprising:

a plurality of panels comprising at least a bottom panel and a transverse fold line extending along a midpoint of the bottom panel;

at least one first end flap foldably connected to at least one panel of the plurality of panels along a first longitudinal fold line at a first marginal end of the carton blank, the at least one first end flap being for at least partially closing a first end of the carton formed from the blank;

at least one second end flap foldably connected to at least one panel of the plurality of panels along a second longitudinal fold line at a second marginal end of the carton blank, the at least one second end flap being for at least partially closing a second end of the carton formed from the blank;

the at least one reinforcing blank comprises at least a first reinforcing blank and a second reinforcing blank, the first reinforcing blank being at least partially adhered to the primary blank at the first marginal end of the carton blank forming a first multi-ply portion of the carton blank, at least a portion of each panel of the plurality of panels comprising a portion of the first multi-ply portion, and at least a portion of the at least one first end flap comprising a portion of the first multi-ply portion, and the second reinforcing blank being at least partially adhered to the primary blank at the second marginal end of the carton blank forming a second multi-ply portion of the carton blank at least a portion of each panel of the plurality of panels comprising a portion of the second multi-ply portion, and at least a portion of the at least one second end flap comprising a portion of the second multi-ply portion; and a dispensing feature extending in the primary blank, the dispensing feature comprising a tear strip extending in the primary blank for separating the carton formed from the carton blank into at least a first dispensing portion and a second dispensing portion, wherein the first dispensing portion and the second dispensing portion are for being free from contact with one another when the tear strip is removed in the carton formed from the carton blank, the first dispensing portion is for comprising the first multi-ply portion of the carton formed from the carton blank, the second dispensing portion is for comprising the second multi-ply portion of the carton formed from the carton blank, and the first dispensing portion is smaller than the second dispensing portion.

12. The carton blank of claim 11, wherein the tear strip comprises at least two longitudinal tear lines.

13. The carton blank of claim 12, wherein the tear strip extends longitudinally across at least a portion of the primary blank.

14. The carton blank of claim 11, wherein the tear strip extends longitudinally across the plurality of panels.

15. The carton blank of claim 14, wherein the plurality of panels comprises at least a first top panel for at least partially overlapping a second top panel when the carton is formed from the carton blank, the tear strip comprising a first portion in the first top panel and a second portion in the second top panel, the first portion of the tear strip being for at least partially overlapping the second portion of the tear strip when the carton is formed from the carton blank.

16. The carton blank of claim 15, further comprising handle features in at least one of the first top panel and the second top panel.

17. The carton blank of claim 14, wherein the tear strip extends proximate to a longitudinal edge of the first reinforcing blank.

18. The carton blank of claim 11, wherein the at least one first end flap comprises a plurality of first end flaps comprising a plurality first primary end flaps in the primary blank overlapping a plurality of first reinforcing end flaps in the first reinforcing blank.

19. The carton blank of claim 11, wherein the first multi-ply portion of the carton blank is spaced apart from the at least one second end flap.

20. The carton blank of claim 11, wherein the tear strip extends in an intermediate portion of the primary blank that is free from contact with the first reinforcing blank and the second reinforcing blank, the tear strip extends in a generally longitudinal direction adjacent an edge of the first reinforcing blank so that the second dispensing portion comprises substantially all of the intermediate portion of the primary blank after the tear strip is removed.

21. A method of forming a carton comprising:

obtaining a primary blank and at least one reinforcing blank for forming a carton blank comprising a plurality of panels comprising at least a bottom panel and a transverse fold line extending along a midpoint of the bottom panel, at least one first end flap foldably connected to at least one panel of the plurality of panels along a first longitudinal fold line at a first marginal end of the carton blank, at least one second end flap foldably connected to at least one panel of the plurality of panels along a second longitudinal fold line at a second marginal end of the carton blank, and a dispensing feature extending in the primary blank, wherein the at least one reinforcing blank comprises at least a first reinforcing blank and a second reinforcing blank, and the dispensing feature comprising a tear strip extending in the primary blank;

forming the carton blank comprising forming a first multi-ply portion and a second multi-ply portion, the forming the first multi-ply portion comprising at least partially adhering at least the first reinforcing blank to the primary blank at the first marginal end of the carton blank so that at least a portion of each panel of the plurality of panels comprises a portion of the first multi-ply portion and at least a portion of the at least one first end flap comprises a portion of the first multi-ply portion, and the forming the second multi-ply portion comprising at least partially adhering at least the second reinforcing blank to the primary blank at the second marginal end of the carton blank so that at least a portion of each panel of the plurality of panels comprises a portion of the second multi-ply portion and at least a portion of the at least one first end flap comprises a portion of the second multi-ply portion;

positioning the plurality of panels to extend at least partially around an interior of the carton; and at least partially removing the tear strip from the to separate the carton into at least a first dispensing portion and a second dispensing portion so that the first dispensing portion and the second dispensing portion are free from contact with one another, wherein the first dispensing portion comprises the first multi-ply portion of the carton, the second dispensing portion comprises the second multi-ply portion of the carton, and the first dispensing portion is smaller than the second dispensing portion.

22. The method of claim 21, wherein the tear strip comprises at least two longitudinal tear lines and the at least partially removing the tear strip comprises tearing along the at least two longitudinal tear lines.

23. The method of claim 21, wherein the plurality of panels comprises at least a first top panel and a second top panel, the tear strip comprises a first portion in the first top panel and a second portion in the second top panel, and the positioning the plurality of panels comprises at least partially overlapping the first top panel and the second top panel so that the first portion of the tear strip at least partially overlaps the second portion of the tear strip.

24. The method of claim 21, wherein the tear strip extends in an intermediate portion of the primary blank that is free from contact with the first reinforcing blank and the second reinforcing blank, the tear strip extends in a generally longitudinal direction adjacent an edge of the first reinforcing blank so that the second dispensing portion comprises substantially all of the intermediate portion of the primary blank after the at least partially removing the tear strip from the primary blank.

* * * * *